US005570916A

United States Patent [19]

Mader

[11] Patent Number: 5,570,916

[45] Date of Patent: Nov. 5, 1996

[54] BREAKAWAY LEVER CLUTCH WITH VERTICAL LIFT TRIM

[75] Inventor: Gerald E. Mader, Indianapolis, Ind.

[73] Assignee: Von Duprin, Inc., Indianapolis, Ind.

[21] Appl. No.: 173,282

[22] Filed: Dec. 27, 1993

[51] Int. Cl.[6] ..... B21D 43/10

[52] U.S. Cl. ..... 292/336.3; 292/DIG. 27; 70/422

[58] Field of Search ..... 292/336.3, 165, 292/169, 169.14, 169.17, 34, 37, 241, DIG. 27, DIG. 30; 70/149, 218, 422, 473

[56] References Cited

U.S. PATENT DOCUMENTS

| | | | |
|---|---|---|---|
| 2,961,866 | 11/1960 | North | 292/169.14 |
| 3,545,799 | 12/1970 | Gertsfeld | 292/34 |
| 3,881,331 | 5/1975 | Tranberg | 70/149 |
| 3,999,411 | 12/1976 | Kambic | 292/165 |
| 4,321,812 | 3/1982 | Pelcin | 70/149 |
| 4,520,736 | 6/1985 | Crosby | 70/1.5 |
| 4,649,725 | 3/1987 | Yamashita | 292/DIG. 27 |
| 4,754,715 | 7/1988 | Squires | 292/241 |
| 5,149,152 | 9/1992 | Lanius | 292/37 |
| 5,290,077 | 3/1994 | Fleming | 292/37 |

FOREIGN PATENT DOCUMENTS

| | | | |
|---|---|---|---|
| 2045337 | 10/1980 | United Kingdom | 292/DIG. 27 |

*Primary Examiner*—Steven N. Meyers
*Assistant Examiner*—Gary Estremsky
*Attorney, Agent, or Firm*—Robert F. Palermo; A. James Richardson

[57] ABSTRACT

A door lever assembly for disengaging an unlocked latch of a lockable door latch assembly includes a lever handle rotatably connected to a trim housing supporting a stop plate. A cam is operably connected to the lever handle and positioned to rotate in response to rotation of the lever handle, converting its rotational movement to linear movement of a movable slider positioned adjacent to the cam. A lift arm is operably connected to vertical rods of the door latch assembly and an over-ride spring is connected between the slider and the lift arm. The over-ride spring transmits motion of the slider to the lift arm to lift the lift arm and the connected vertical rods when the door latch assembly is in an unlocked position. The over-ride spring compresses in response to slider movement when the blocking slide is positioned to block movement of the lift arm when the door latch assembly is in its locked position, preventing damage to components of the door lever assembly. In an unlocked position, a pivot rotates to control contact between the slider and the stop plate.

11 Claims, 7 Drawing Sheets

BREAKAWAY LEVER CLUTCH WITH VERTICAL LIFT TRIM

BACKGROUND OF THE INVENTION

The present invention relates to a door lever assembly that resists vandalism and breakage. More specifically, the present invention relates to single or double door lever assembly having a breakaway door handle rotatably connected to a cam propelled slider for operating a door latch, and a key cylinder lock mechanism for blocking operation of the slider.

Conventional door levers having a fixed lock position are subject to damage by vandals or those seeking unauthorized entry into commercial or public buildings. A locked door lever extending outward in a substantially horizontal position can be impacted with hammers or other devices to break the lever or shatter lock components. In addition, it is sometimes possible to use the weight of a person seeking entry to downwardly force a door lever and break the lock mechanism. To partially overcome this problem, certain door levers are designed to have shear pins or other elements for designed failure that break and render the lever mechanism inoperable after application of undue force.

For example, a conventional door lever typically has a trim housing configured to accommodate a key cylinder lock above a rotatable lever handle that is operably connected to a door latch mechanism. The lever handle is permanently pinned to a shaft that extends inward to engage an eccentrically configured cam. The cam can be rotated to upwardly move a slider plate that is in turn connected to a lift arm. Movement of the lift arm in turn causes movement of vertically directed rods that are connected to retract a door latch. Locking this assembly simply requires rotation of the key cylinder to engage a blocking slide known as a trim lock tumbler that prevents movement of the lift arm, and consequently fixes the slider, cam, shaft, and door lever in a fixed and locked position.

However, with this type of assembly the door lever handle is fixed (in its locked position) to extend horizontally outward. To prevent permanent damage to the lock mechanism, a shear pin is provided to connect the cam and the shaft. Application of excessive torque forces to the lever handle causes failure of the shear pin, effectively disconnecting the lever and attached shaft from the remaining elements of the door lever assembly. Although this protects the remaining lock elements from further damage, it does require removal of the trim housing and replacement of the shear pin to restore lever function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one embodiment, the present invention overcomes this and other problems by providing a novel breakaway lever assembly for disengaging an unlocked latch of a lockable door latch assembly. The lockable door latch assembly has an unlocked and a locked position, with vertical rods movable in the unlocked position to release a door latch, and a blocking slide movable to the locked position to prevent movement of the vertical rods and the connected door latch. The novel breakaway lever assembly controls opening and closing of the door latch assembly by provision of a lever handle rotatably connected to a trim housing and its attached stop plate and a cam operably connected to the lever handle.

The cam is rotatably attached with respect to the trim housing and positioned to rotate in response to rotation of the lever handle. In response to this rotation of the cam, a slider engagable with the cam is vertically moved with respect to the lever assembly and trim housing. The slider is indirectly connected to the door latch assembly by way of a lift arm connected to the vertical rods of the door latch assembly. In addition, the slider supports an attached elastomer, with the slider being movable toward the stop plate in response to rotation of the cam. A rotatable pivot is held by the slider and the lift arm to contact the stop plate when the door latch assembly is in its unlocked position, with the rotatable pivot rotating out of position to allow contact between the elastomer attached to the slider and the stop plate when the slider is moved when the door latch assembly is in its locked position.

When the door latch assembly is locked, an over-ride spring is connected between the slider and the lift arm may be engaged. The over-ride spring is biased to normally transmit motion of the slider to the lift arm to lift the lift arm and the connected vertical rods when the door latch assembly is in its unlocked position. However, when the door latch assembly is locked with the blocking slide moved downward to engage the lift arm, the over-ride spring compresses in response to slider movement.

The foregoing and other aspects will become apparent from the following detailed description of the invention when considered in conjunction with the accompanying drawing figures.

DETAILED DESCRIPTION

Figure 1:
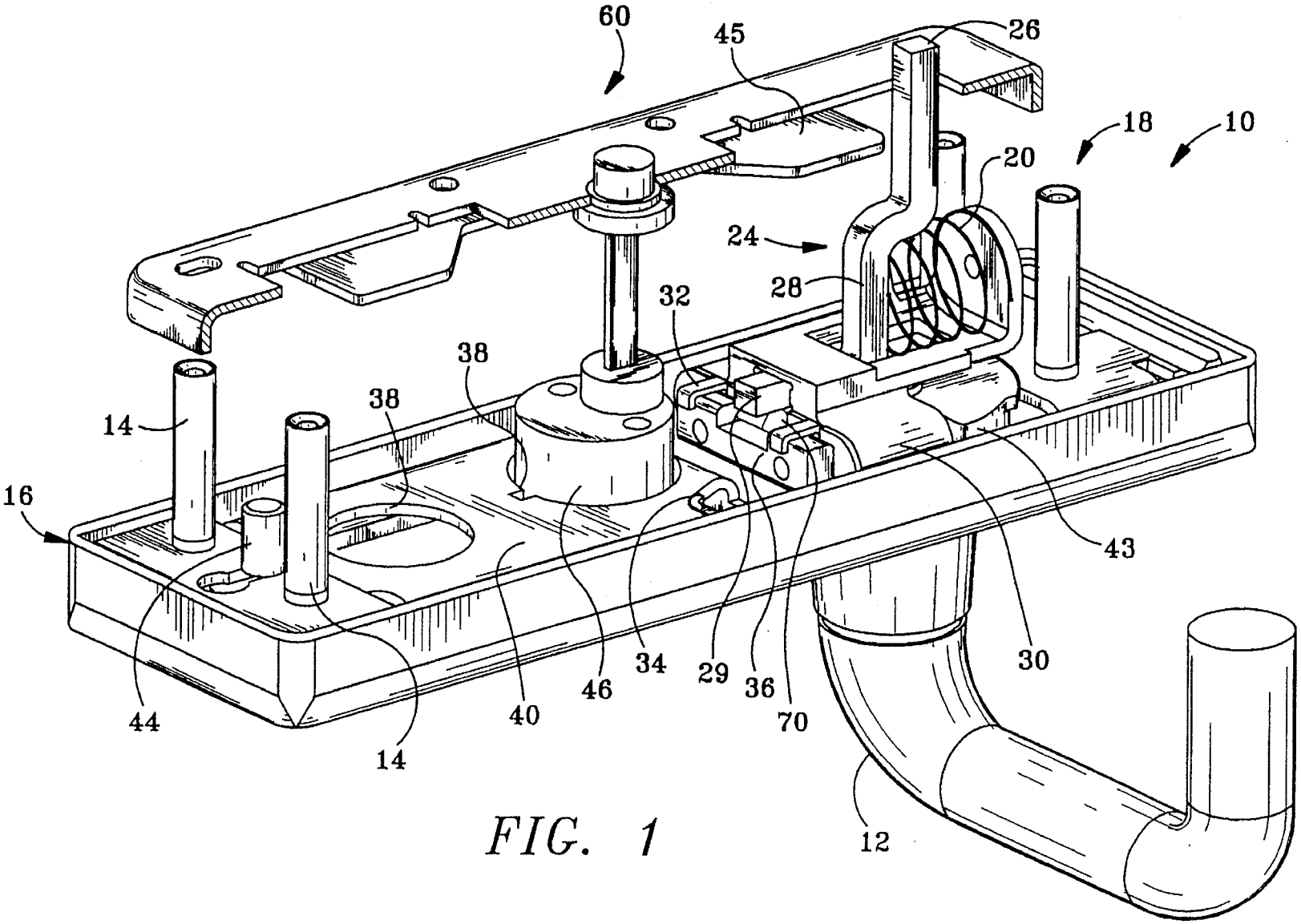
FIG. 1 is a perspective view of a door lever assembly in accordance with the present invention, showing an outwardly extending lift arm for engagement with a door latch assembly (not shown), an over-ride spring assembly positioned adjacent to the lift arm, and a door lever handle in its horizontally outward extending position.
Figure 7:
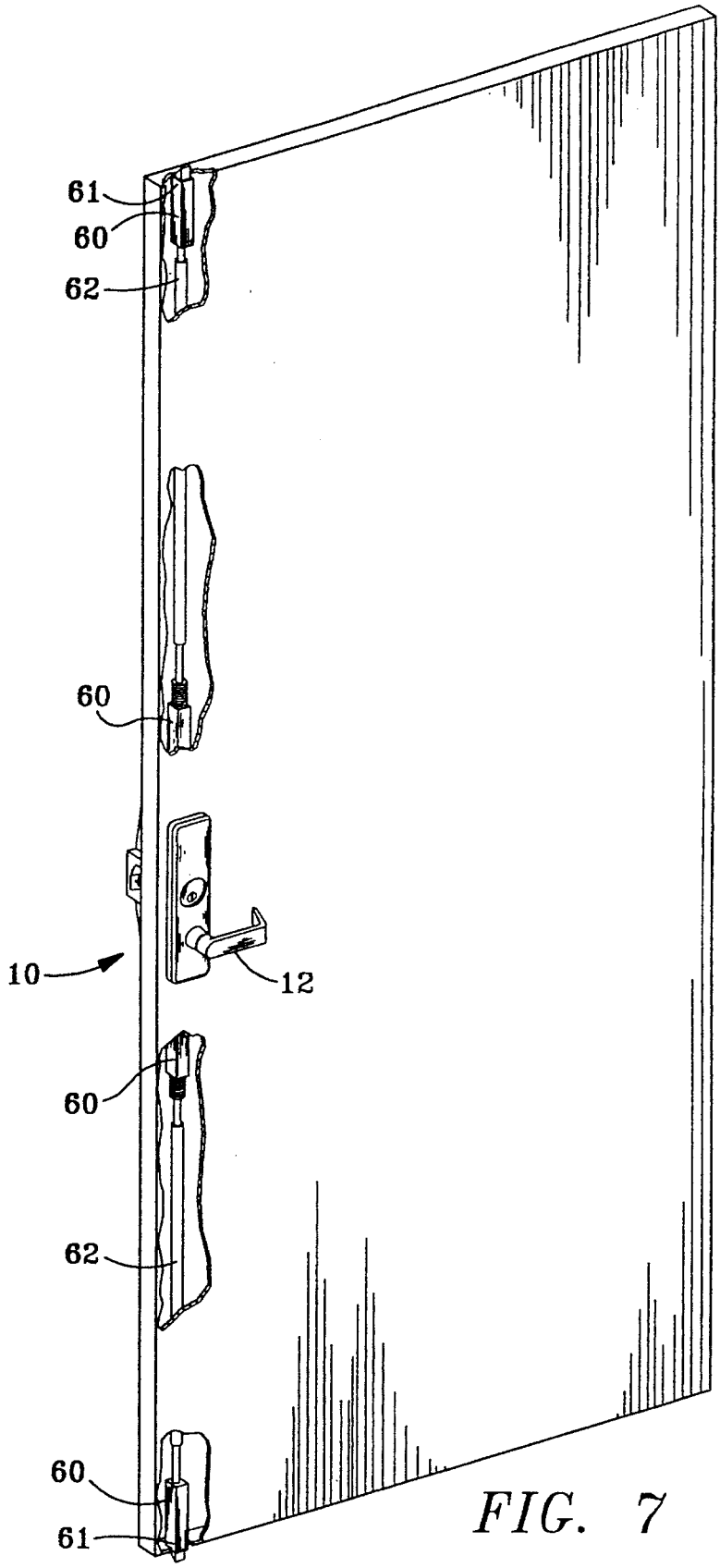
FIG. 7 is a perspective view of a door lever assembly accommodated in a latchable door, with the door partially broken away to indicate vertically extending rods in the door that are movable in response to rotation of the unlocked door lever assembly.

As illustrated in FIGS. 1 and 7, a door lever assembly 10 for use in single (as shown in FIG. 7) or double door applications includes a lever handle 12 and mounting studs 14 for a trim housing 16. Turning the lever handle 12 results in movement of a lift arm 24, which is engaged to move connected vertical rods 62 that operate retraction or extension of door latches 61. The lever handle 12 is of conventional design. The trim housing 16 can be attached to a door by engagement with mounting studs 14, which are typically threaded to allow easy screw attachment or disengagement. The trim housing 16 supports on its interior permanently attached weld studs 44. The weld studs 44 retain a plate 40 that defines therethrough two door lock apertures 38.

As best shown in FIG. 1, a key cylinder 46 for locking the door can be attached to extend through the trim housing 16 to engage and control positioning of a blocking slide 45 of a door latch lock control assembly 60. As best shown in FIG. 7, the door latch lock control assembly 60 includes vertically directed rods 62 movably connected between latches 61 and lift arm 24. The blocking slide 45 is moved upward or downward by rotation of key cylinder 46. When the blocking slide 45 is positioned in its unlocked, upward position, (such as shown in FIG. 1) movement upward of the lift arm 24 to retract door latches 61 is not impeded. The lift arm 24 typically is constructed from a single integral piece of metal to have a flat lock engaging portion 26 and a flat spring engaging portion 28 joined by a curved intermediate portion. A short extension of the lift arm 24 also includes a pivot block 29. The lock engaging portion 26 engages the blocking slide 45 of the door latch lock control assembly when the blocking slide 45 is positioned in its locked position.

The spring engaging portion 28 of the lift arm is conformably attached to an over-ride assembly 18 that includes an over-ride spring 20. The over-ride spring 20 is typically configured to have a high spring constant, and under normal operating torque is essentially inelastic. In addition, a preload of approximately 70 pounds is commonly imparted to the spring to result in an initial lever torque of about 10 foot-pounds. However, when sufficiently high forces are exerted the preload force will be overcome and the spring 20 will begin to compress. As will be appreciated by those skilled in the art, the exact spring material and configuration can be varied, and it is even possible to use elastomeric materials in place of coiled springs as necessary.

The spring engaging portion 28 of the lift arm 24 is also attached to a vertically movable slider 30. The slider 30 is a generally flat plate that is vertically movable with respect to the trim housing 16. Rotation of an eccentrically configured cam 42 causes a cam wing 43 to upwardly push the slider 30, which in turn upwardly impels the lift arm 24. As best seen in FIG. 1, the slider 30 has an attached elastomer 36 for engagement with a stop plate 34 defined by the lower edge of the plate 40. Use of a compressible elastomer is important for operation of the present invention, since the elastomer can be slightly compressed if the cam 42 continues to rotate. This provides sufficient room for the cam wing 43 to slip underneath the slider 30, effectively disengaging the cam 42 from the slider 30.

For normal operation without application of excessive forces, dual lift springs 32, one of which can be seen in FIG. 1, are attached at opposite edges between the slider 30 and plate 40. The lift springs 32 are biased to normally push the slider 30 downward, which in turn acts to rotate the cam 42 and return the lever to a horizontal position. However, these lift springs 32 are ineffective if the cam 42 has been rotated to slip the cam wing 43 past the slider 30.

Figure 6:
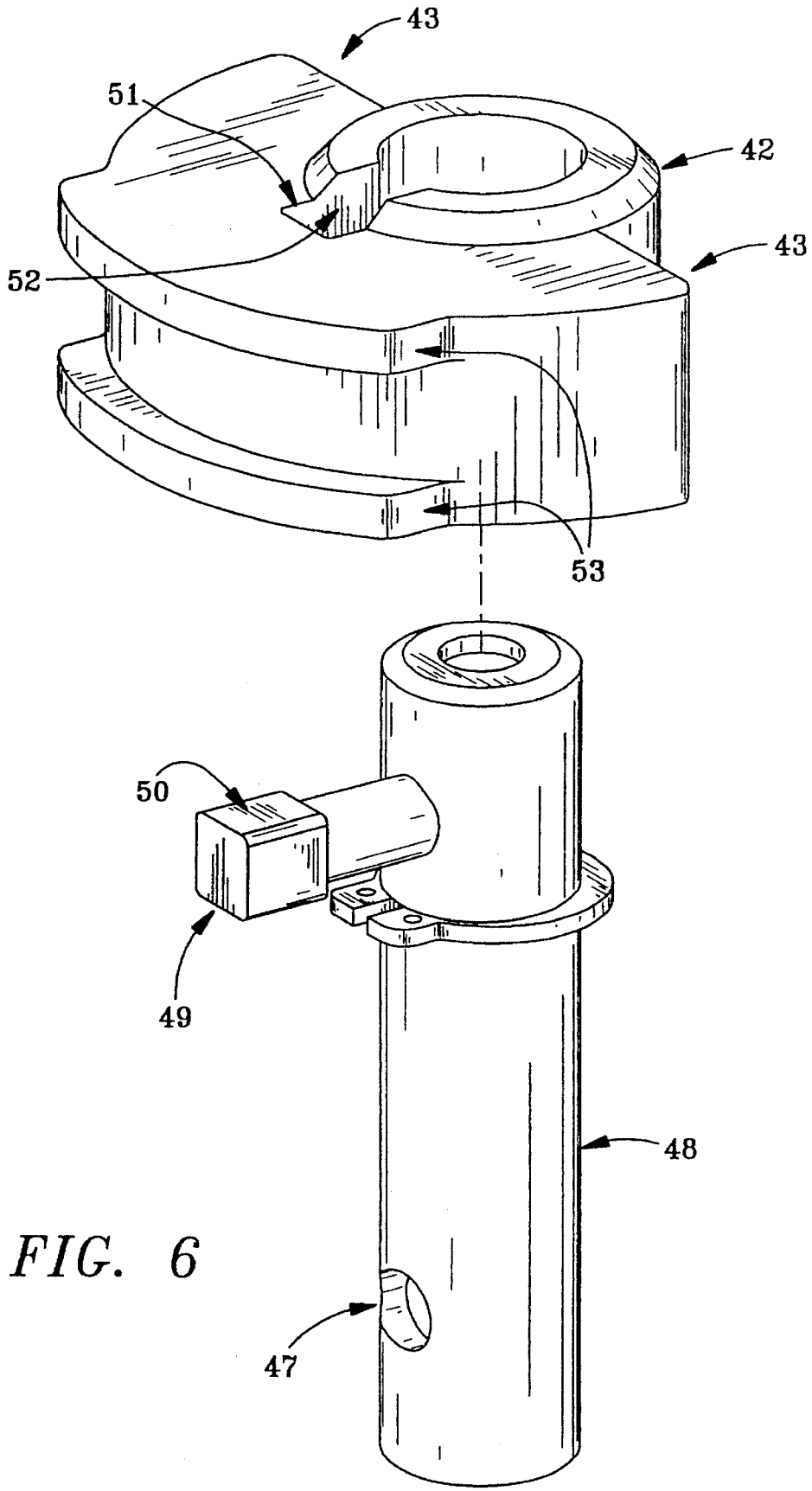
FIG. 6 is a perspective view of a shaft for connection to the door lever, with a shear pin for connection with an eccentric cam being indicated.

Manual rotation of the cam 42 is driven by rotation of the door lever handle 12. As illustrated in part in FIG. 6, the door lever handle 12 (not indicated in the Figure for clarity) can be connected by a pin (not shown) to a lever connection site 47 defined at one end of a shaft 48. At an opposite end of the shaft 48, a shear pin 49 having a plurality of flat edges 50 is attached. The shear pin 49 fits into a shear pin connection site 51 having matching flat edged walls 52 defined by the cam 42. As seen in FIG. 6, the shear pin 49 extends outward in one direction for engagement with the cam 42. As long as torque is maintained within predefined limits, rotation of the door lever handle 12 results in rotation of the shaft 48, and consequent rotation of the shear pin connected cam 42. If rotation of the cam 42 is prevented, as is the case when the door lever assembly is locked and a stop 53 on the cam 42 prevents further cam rotation, application of excessive torque to the door lever handle 12 results in breakage of the shear pin, disconnecting the lever handle 12 from the cam 42.

Figure 2:
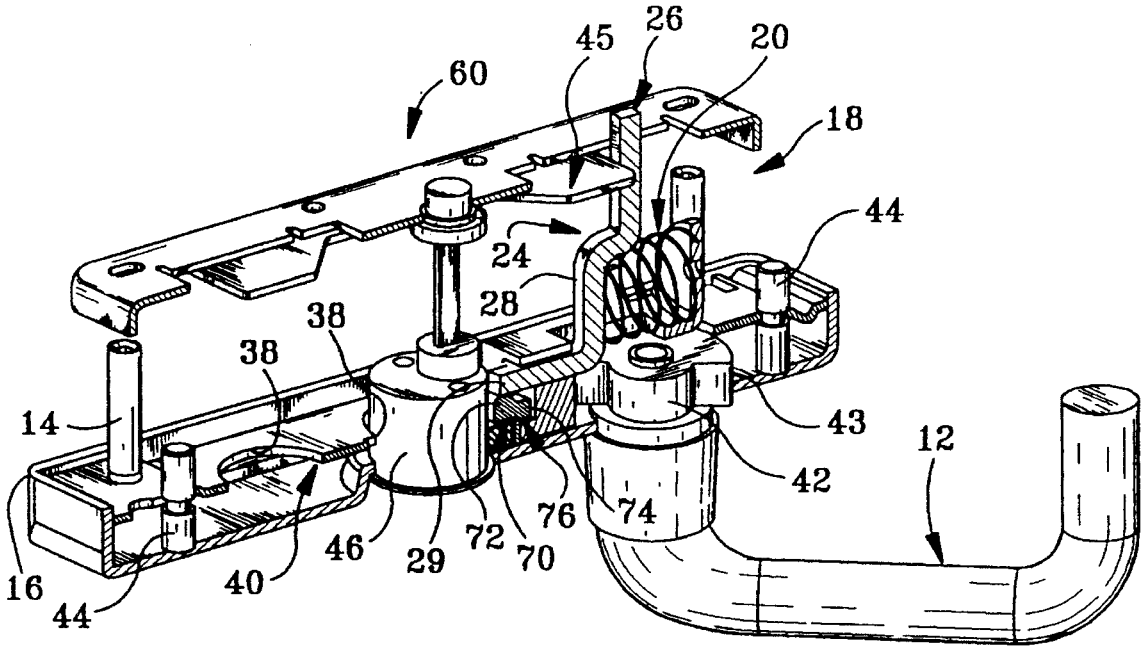
FIG. 2 is a broken away perspective view of the door lever assembly in an unlocked position with the lift arm blocking rotation of the pivot and the over-ride spring uncompressed, the trim housing being removed for clarity.
Figure 3:
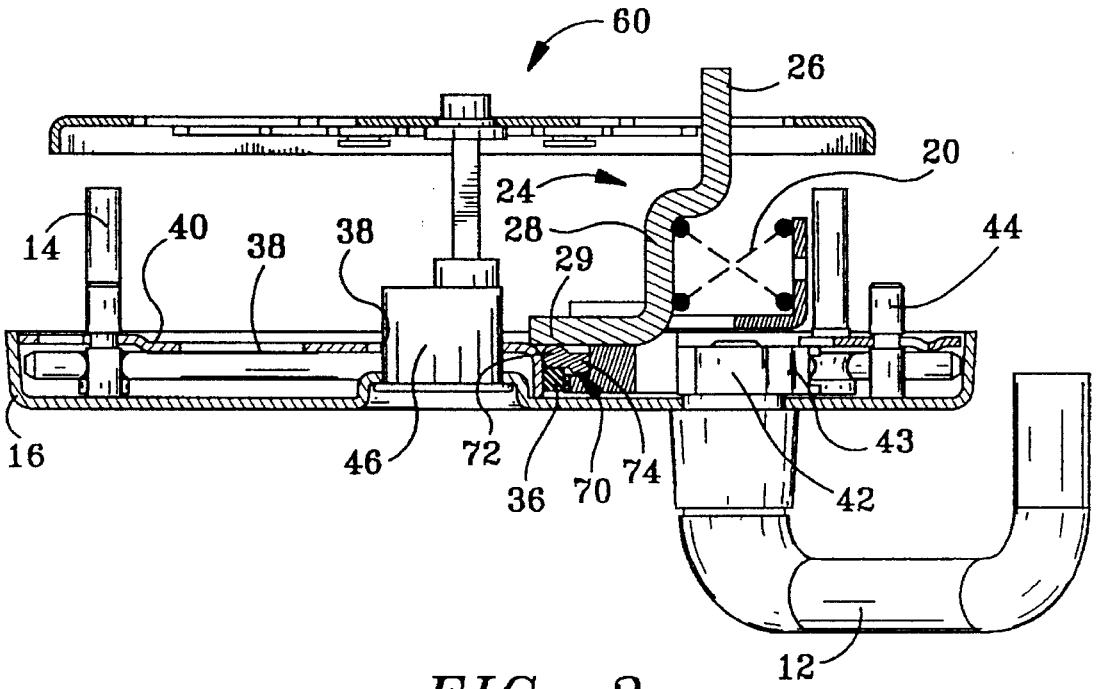
FIG. 3 is a side view of the door lever assembly illustrated in FIG. 2.

In its unlocked position, operation of the door lever assembly 10 in accordance with the present invention is augmented by the presence of a pivot 70. As best seen in FIGS. 2 and 3, the pivot 70 is has a first lobe 72 separated from a second lobe 74 by a narrow waist 76. The pivot is typically constructed from a durable metal configured to withstand substantial compressive and shear forces without deformation. As best seen in the unlocked position of FIGS. 1 and 3, the bias of the lift springs 32 maintains the door lever handle 12 in a substantially horizontal position to allow easy grasping of the handle by a user desiring to open a door. To open the door, the handle 12 is rotated downward, consequently rotating the shaft 48 and shear pin 49 connected cam 42. Rotation of the eccentrically configured cam 42 is converted into upward, linearly directed movement of the slider 30 as the wing 43 of the cam engages and impels the slider 30 upward against the biasing force exerted by the lift springs 32.

Movement of the slider 30 also causes movement of the connected lift arm 24. As the lift arm 24 is raised, connected vertical rods 62 of the door latch assembly 60 are also moved to release the door latches 61 and allow opening of the door. During movement of the lift arm 24, the over-ride spring 20 is essentially uncompressed due to its high spring constant and the relatively low compression forces exerted. However, rotation of the lever handle 12 beyond about 50 to 55 degrees from horizontal is impeded by interaction of the essentially incompressible pivot 70 connected to the slider and held in position by the pivot block 29 of the lift arm 24. The pivot 70 contacts both the slider 30 and the stop plate 34, preventing further movement of the slider 30 toward the stop plate 34, and importantly preventing contact between the elastomer 36 attached to the slider 30 and the stop plate 34. If the pivot 70 was not in position, the elastomer 36 attached to the slider 30 would contact with stop plate 34. Further attempts to rotate the handle will cause the elastomer to compress, allowing the cam wing 43 to slip past the slider 30 so that it is no longer engaged. However, this situation is undesirable because the vertical rods 62 and latches 61 would be maintained in a retracted "dogged open" position. By having the incompressible pivot 70 drop into position such as shown in FIGS. 2 and 3, the cam wing 43 cannot slip past the slider 30 before its shear pin is broken, disengaging the lever from the cam 42.

Figure 4:
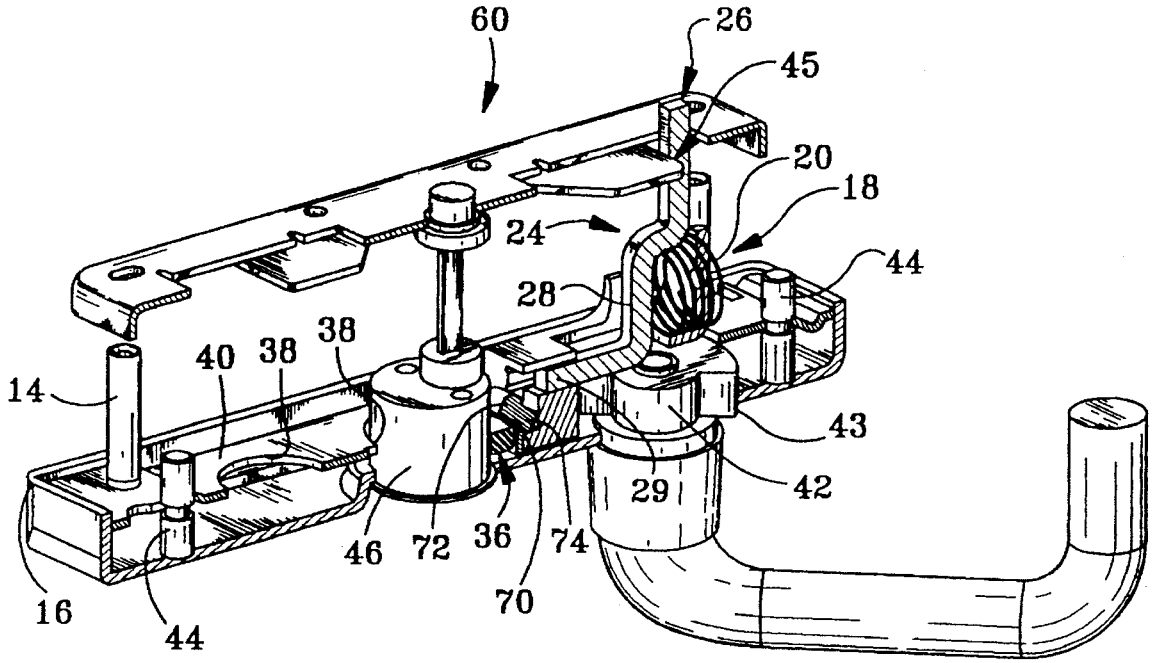
FIG. 4 is a broken away perspective view of the door lever assembly in its locked position, showing orientation of the pivot when it is not constrained by the lift arm.
Figure 5:
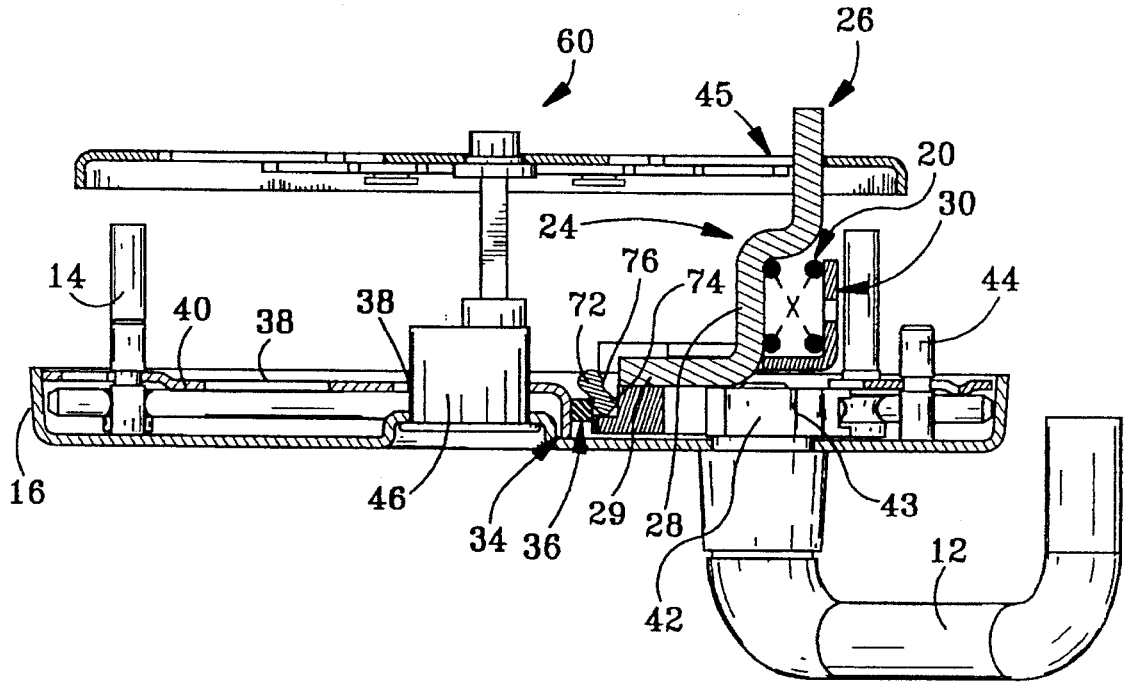
FIG. 5 is side view of the door lever assembly illustrated in FIG. 4.

Operation of the lever handle is altered when the blocking slide is moved downward into a locking position. As best seen in FIGS. 4 and 5, the blocking slide 45 prevents upward movement of the lift arm 24. Since movement of the lift arm 24 is prevented, the pivot 70 is free to rotate, with its first lobe 72 rotating back toward the slider 30 to permit direct contact between the elastomer 36 and stop plate 34. In addition, movement of the connected slider, cam, shaft, and door lever handle is inhibited. Someone trying to open the door would realize from the resistance to movement of the door lever handle that the door is locked.

However, if someone is trying to force the door by using their weight, pry bars, hammers, or other tools to drive the door lever handle downward, the preload force on the over-ride spring can be overcome and the door handle will rotate to a downwardly directed position. With the present device, the lift arm does not move upward. Instead, against increasingly greater resistance the cam 42 can be force to rotate. As the cam rotates, the slider 30 moves upward, compressing the over-ride spring 20, but not causing movement of the lift arm 24. When the door lever handle is rotated to a downward position of about 50 to 55 degrees, the elastomer 36 engages the stop plate 34. Application of further torque force against the door lever handle 12 merely causes the elastomer 36 to compress, allowing the cam wing 43 to slip past the slider 30 so that it is no longer engaged. Disengagement of the cam 42 from its interaction with the slide 30, allows the lever to travel to a vertically downward position. However, since the lift arm 24 has not been lifted (because of its engagement with the blocking slide 45 and the compression of the over-ride spring 20), the vertical rods 62 remain unmoved, and the latches 61 remain normally engaged to hold the door closed.

Figure 8:
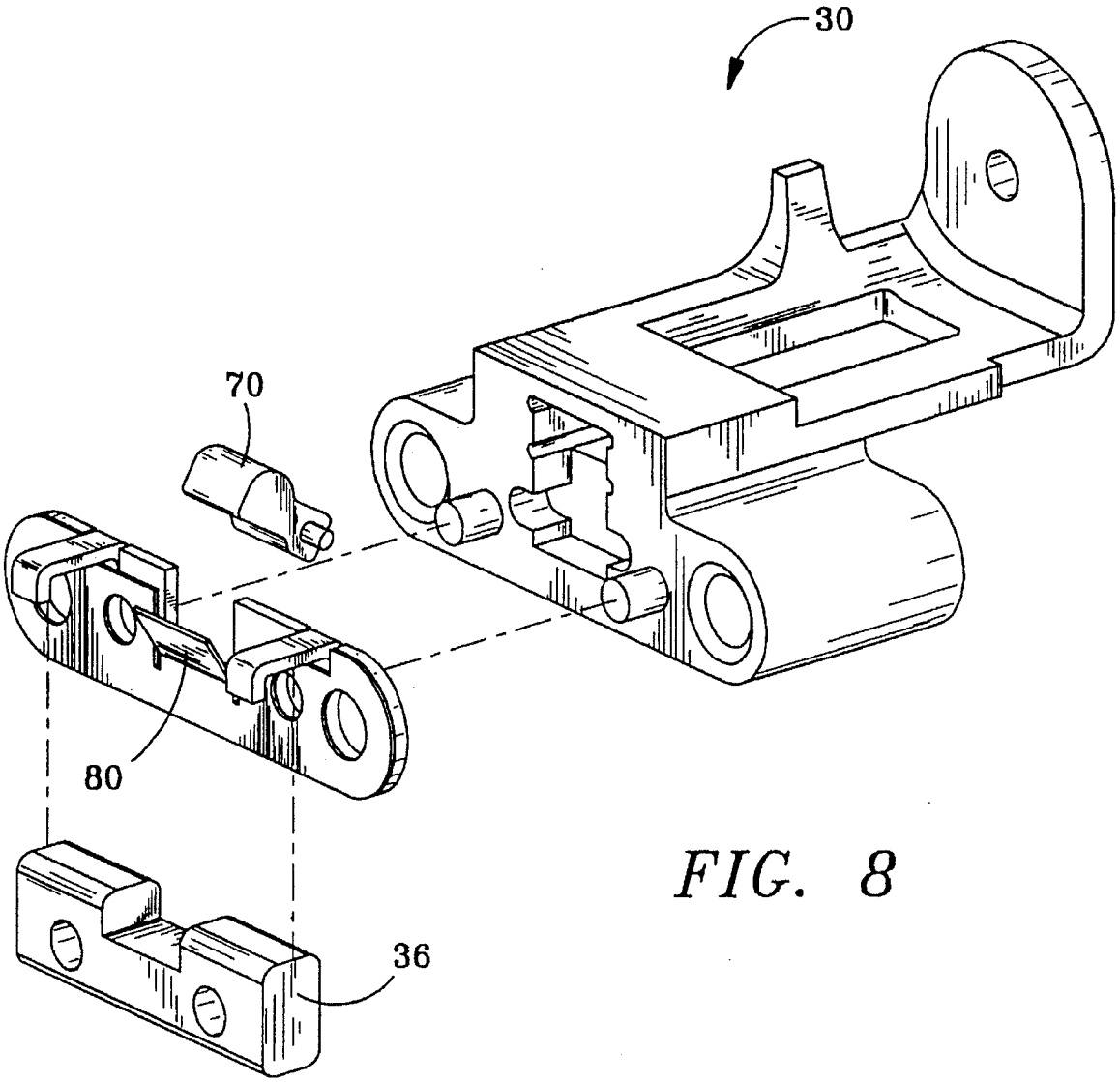
FIG. 8 is an exploded perspective view of a slider supporting an optional leaf spring that actively urges rotation of the pivot.
Figure 9:
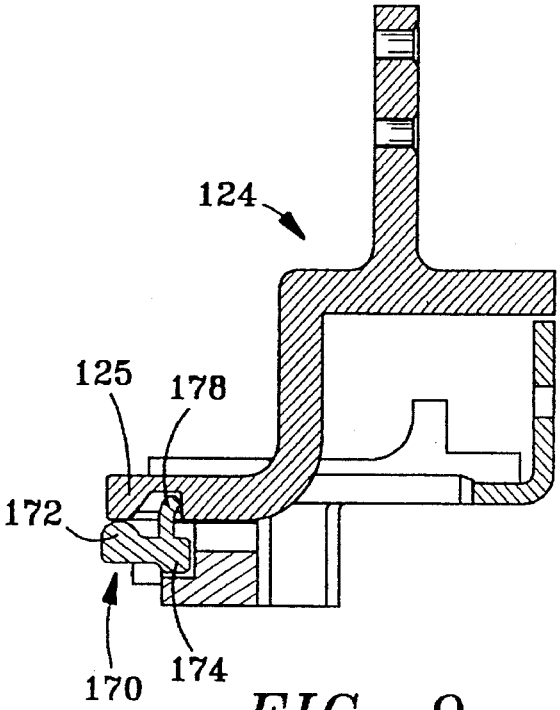
FIGS. 9, 10, 11, and 12 sequentially illustrate rotational action of an alternative embodiment of a pivot and a lift arm, with the pivot supporting an extending pivot arm that is engagable by a lift hook defined by the lift arm to actively urge rotation of the pivot.
Figure 10:
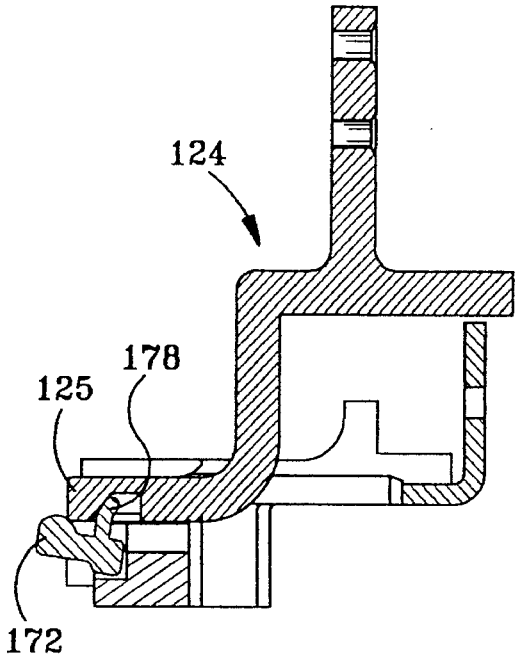
Figure 11:
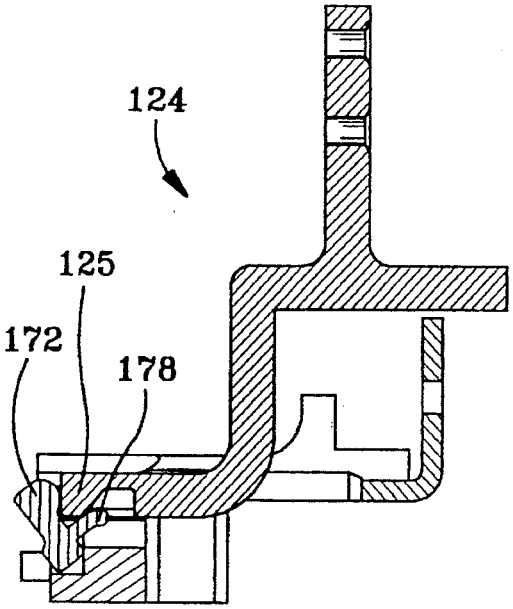
Figure 12:
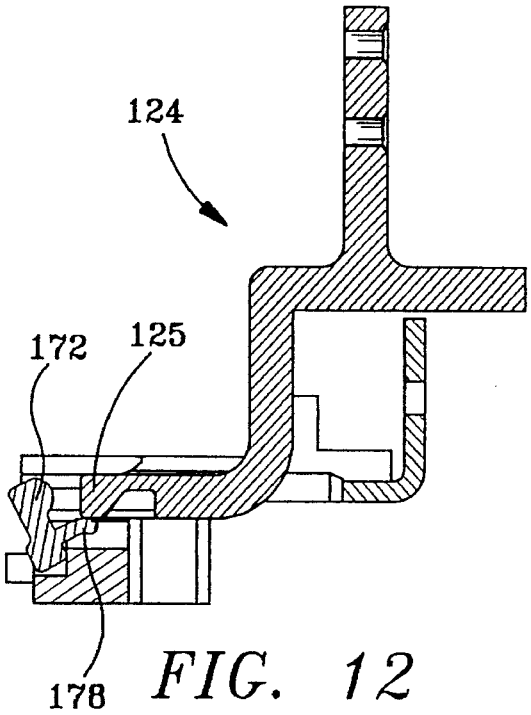

As described in relation to FIGS. 1–5, when the pivot 70 is not prevented from rotating by the lift arm 24, the pivot 70 simply rotates from a position such as shown in FIG. 3 to a position such as shown in FIG. 5 solely in response to gravitational force. However, to ensure that this required rotation occurs without respect to gravitational orientation, it is also contemplated to rely upon a leaf spring 80 connected to the slider 30 such as illustrated in FIG. 8. The leaf spring 80 provides a constant biasing force against the pivot 70 that can be overcome by the lift arm 24 moving toward the stop plate 34. However, when the lift arm is positioned away from the pivot 70, such as illustrated by FIG. 5, the leaf spring 80 illustrated in FIG. 8 urges rotation of the pivot 70, acting to enhance the normal gravitionally urged tendency of the pivot 70 to rotate to the position seen in FIG. 5.

Alternatively, instead of being urged by springs such as described in connection with FIG. 8, a pivot can be designed to be actively pulled into a new position as the lift arm retracts. This is illustrated in connection with FIGS. 9 through 12, which sequentially illustrate a lift arm 124 having a lift hook 125 that pulls pivot arm 178. The pivot arm 178 is an integrally formed extension of a pivot 170, and as illustrated in the FIGS. 9 through 12 is pulled by the lift hook 125 to rotate a first lobe 172 out of blocking position. Functionally, the embodiment of the invention illustrated in these FIGS. 9 through 12, as well as the embodiment illustrated in FIG. 8, act in substantially the same manner as that described in connection with FIGS. 1–7. The only functional difference of these alternative embodiments is an insensitivity to gravitational direction, and improved pivoting reliability.

Advantageously, all embodiments of the present invention allow the normal operation and use of a door lever assembly that is substantially identical to conventional door lever assemblies when normal forces are exerted. However, when excessive forces are exerted against the door lever handle, such as applied in attempts to force a door lock or vandalize, in an unlocked position the present mechanism disengages the lever from the cam by breakage of the shear pin to prevent damage to the door lever assembly. In the locked position, the novel door lever assembly absorbs blows (by the over-ride spring) and then disengages to prevent damage. Because of the use of the over-ride spring and the elastomer/stop plate interaction, in single door applications there will be typically no need to rely on shear pin failure to prevent damage to the locked door lever assembly. However, to prevent unwanted dogging open of the door, shear pin failure is still needed as a last resort should excessive forces be applied to an unlocked door. However, as compared to conventional devices, the improved shear pin design and placement make shear pin failure both easier to rely upon and easier to replace.

While the present invention has been described in connection with specific embodiments, it will be apparent to those skilled in the art that various changes may be made therein without departing from the spirit or scope of the invention.

What is claimed is:

1. A lever assembly for disengaging an unlocked latch of a lockable door latch assembly, the door latch assembly having an unlocked and a locked position, with vertical rods movable in the unlocked position to release a door latch, and a blocking slide movable to the locked position to prevent movement of the vertical rods and the connected door latch, the lever assembly comprising:

a trim housing supporting a stop plate;

a lever handle rotatably connected to the trim housing;

a cam operably connected to the lever handle and positioned to rotate in response to rotation of the lever handle;

a slider supporting an attached elastomer, the slider being movable toward the stop plate in response to rotation of the cam;

a lift arm connected to the vertical rods of the door latch assembly;

a rotatable pivot held by the slider and the lift arm to contact the stop plate when the door latch assembly is in its unlocked position, with the rotatable pivot rotating out of position to allow contact between the elastomer attached to the slider and the stop plate when the slider is moved when the door latch assembly is in its locked position; and an over-ride spring connected between the slider and the lift arm, with the over-ride spring transmitting motion of the slider to the lift arm to lift the lift arm and the connected vertical rods when the door latch assembly is in its unlocked position, and with the over-ride spring compressing in response to slider movement when the blocking slide is positioned to block movement of the lift arm when the door latch assembly is in its locked position.

2. The lever assembly of claim 1, further comprising a shaft attached between the lever handle and the cam, with a breakable shear pin attaching the shaft to the cam.

3. The lever assembly of claim 2, wherein the breakable shear pin has at least one flat side to engage a flat wall defined by the cam.

4. The lever assembly of claim 2, wherein the breakable shear pin extends outward from the shaft in only one direction to engage the cam.

5. The lever assembly of claim 1, further comprising a compressible lift spring positioned between the stop plate and the slider for compression as the slider moves toward the stop plate and expansion to move the slider away from the stop plate and return the lever handle to an initial position upon release of the lever.

6. The lever assembly of claim 1, wherein the pivot is configured to have a first lobe separated from a second lobe by a narrow waist.

7. The lever assembly of claim 6, wherein the cam is configured to slip past the slider after engagement of the elastomer and the stop plate to permit circular rotation of the lever handle when the pivot is rotated to prevent its contact with the stop plate and the door latch assembly is in its locked position.

8. The lever assembly of claim 1, wherein the lever handle in an initial position is directed horizontally, and wherein the cam disengages from moving contact with the slider when the lever handle is forced past a vertical position.

9. A lever assembly for a latchable door having a latch assembly positionable in both a locked and an unlocked position, the lever assembly comprising:

a trim housing configured to accommodate a rotatable lever handle, a rotatable key cylinder, and a stop plate;

a slider movable in relation to the trim housing;

an elastomeric element positionable between the stop plate and the slider;

means for vertically moving the slider in response to rotation of the lever handle;

a lift arm connected to the slider;

a selectively compressible element connected between the slider and the lift arm, with the selectively compressible element biased to transmit motion of the slider to the lift arm to move the lift arm and the connected latch assembly when the latchable door is in its unlocked position, and with the selectively compressible element compressing in response to slider movement when movement of the lift arm is blocked when the latchable door is in its locked position; and a pivot configured to prevent engagement of the elastomeric element, the slider, and the stop plate when the latch assembly is in an unlocked position, and to permit engagement of the elastomeric element, the slider, and the stop plate when the latch assembly is in a locked position.

10. The lever assembly of claim 9, wherein the means for vertically moving the slider comprises an eccentric configured cam, with the cam attached to a shaft extending between the lever handle and the cam, and with a breakable shear pin having at least one flat side attaching the shaft to the cam so that excessive torque will cause failure of the shear pin and disengage the cam and the shaft when the latch assembly is in its unlocked position.

11. A door lever assembly for disengaging an unlocked latch of a lockable door latch assembly, the door latch assembly having an unlocked and a locked position, the lever assembly comprising:

a lever handle operably connected to the latch of the lockable door latch assembly;

a cam positioned to rotate in response to rotation of the lever handle;

a stop plate;

a slider movable in relation to the stop plate in response to rotation of the cam;

an elastomeric element attached to at least one of the slider or the stop plate;

a pivot rotatable to a position preventing contact between the slider, elastomeric element, and stop plate when the door latch assembly is in an unlocked position, the pivot being rotatable to a position allowing contact between the slider, elastomeric element, and stop plate when the door latch assembly is in a locked position; and a shaft extending in fixed attachment between the lever handle and the cam with a breakable shear pin attaching the shaft to the cam, said breakable shear pin being configured to break upon application of a predetermined amount of torque to the lever handle when the door latch assembly is in its unlocked position.

* * * * *